United States Patent [19]

Taylor et al.

[11] 4,158,746

[45] Jun. 19, 1979

[54] CABLE WITH COLOR CODING IDENTIFICATION OF GROUPS

[75] Inventors: David W. Taylor, Chateauguay; Jean P. Waucheul, LaSalle, both of Canada

[73] Assignee: Northern Telecom Limited, Montreal, Canada

[21] Appl. No.: 901,462

[22] Filed: May 1, 1978

[51] Int. Cl.[2] ..... H01B 7/36

[52] U.S. Cl. ..... 174/112

[58] Field of Search ..... 174/112

[56] References Cited

U.S. PATENT DOCUMENTS

| | | | |
|---|---|---|---|
| 1,667,824 | 5/1928 | Richey | 174/112 |
| 1,856,676 | 5/1932 | Weston | 174/112 |
| 3,020,335 | 2/1962 | Gillis | 174/112 |
| 3,031,524 | 4/1962 | Hicks | 174/112 |

*Primary Examiner*—Richard R. Kucia
*Assistant Examiner*—J. Bouchard
*Attorney, Agent, or Firm*—Sidney T. Jelly

[57] ABSTRACT

A cable comprises a plurality of conductors arranged in one or more units of a predetermined number of conductors, with each unit having one or more groups of conductors, the conductors of each group having a common color code arranged so that an outer layer of the conductors in a unit presents a predetermined color impression to identify gauge size of the conductors. The invention is particularly applicable to telecommunication cables having a plurality of twisted pairs of conductors, arranged in one or more units each of one or more groups, one conductor of each pair in a group having a common color and the other conductor having a color code indicative of twist type. The cable conductors can readily be separated into readily identified groups, for use in modular splicing for example, and the units are made up so that the outer layer has a color dominance, by the conductors having a common color in a group, to indicate the gauge of the conductors. The units can be identified by a colored binder.

12 Claims, 5 Drawing Figures

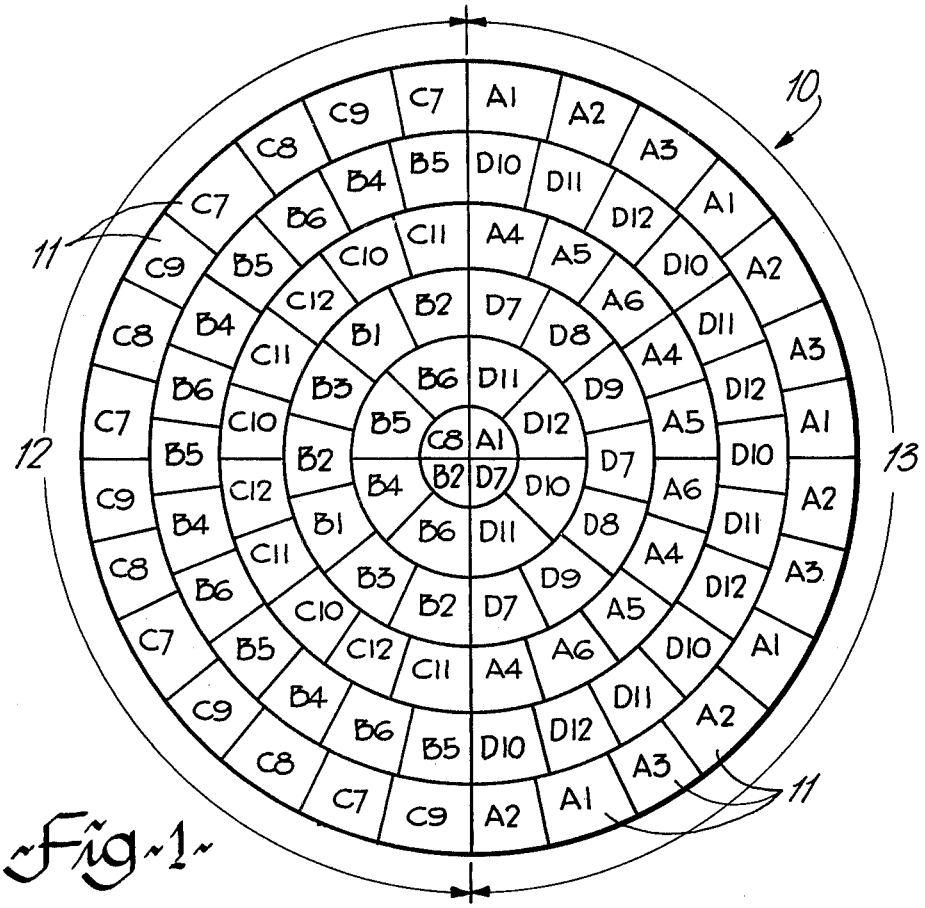
10
11
12
13
11
A1 A2 A3 A1 A2 A3 A1 A2 A3 A1 A2 A3
B1 B2 B3 B4 B5 B6 B1 B2 B3 B4 B5 B6
C7 C8 C9 C10 C11 C12 C7 C8 C9 C10 C11 C12
D7 D8 D9 D10 D11 D12 D7 D8 D9 D10 D11 D12
A1 A2 A3 A4 A5 A6
B1 B2 B3 B4 B5 B6
C7 C8 C9 C10 C11 C12

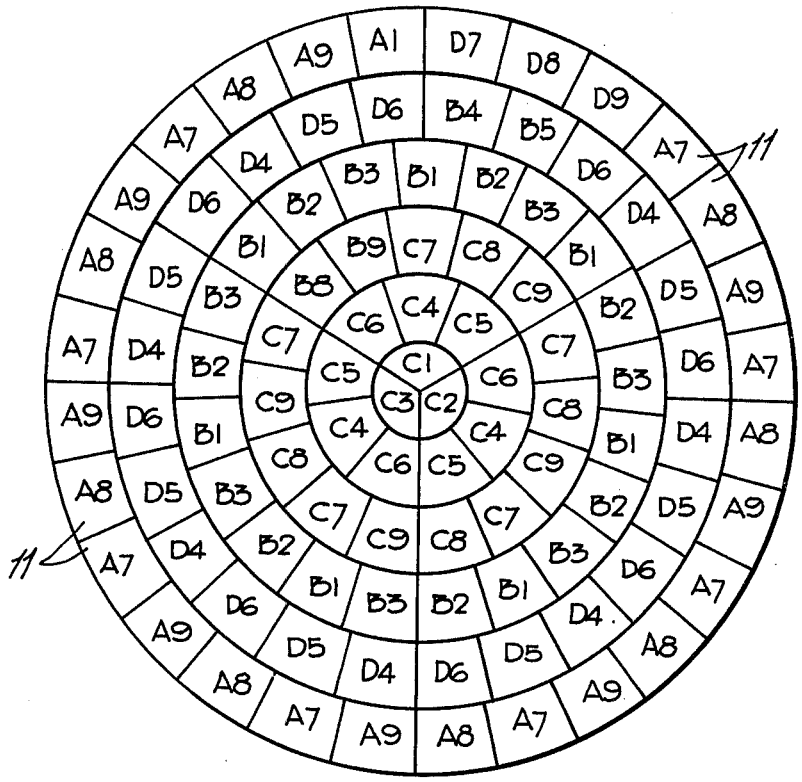
A1
D7
D8
D9
A7
11
A8
A9
A7
A8
A9
A7
A8
A9
A7

CABLE WITH COLOR CODING IDENTIFICATION OF GROUPS

This invention relates to a cable with color code identification of groups, and in particular is concerned with the identification of groups composed of a predetermined number of pairs of conductors in telecommunications cables.

It has been the practice in splicing cables to connect each conductor at one cable end to a conductor in the next cable end, as by crimping, soldering or the like. In telecommunications cables the conductors are usually in pairs, i.e. Tip and Ring, and conductors are spliced in pairs at cable splices.

Modular splicing systems for splicing cables are being used more and more extensively for joining cable lengths. The connectors used in modular splicing accept a predetermined number of pairs; for example, twenty-five pairs, and this predetermined number of pairs is identified throughout the cable run for purposes of cable plant administration. To obtain the maximum benefits from this system, it is essential that the cable construction permit easy division of the cable into groups with the predetermined number of pairs.

For economy and convenience, cables are made up in units of a predetermined number of conductors, for example one hundred pairs. The twisted pairs of conductors (e.g. 100 pairs) are passed through the head of the unit stranding machine, and a unit binder is applied, the whole assembly being twisted prior to winding on the take-up reel (or other container). Previously it has been proposed to form such a unit into sub-units, for example of twenty-five pairs, by separately binding together the pairs of conductors into the sub-units. However this complicates the machine head as provision must be made for oscillating each sub-unit. Also, because of the sub-units being bound individually, the final size of a unit is larger. As many cables are made up of a number of units, there is quite a substantial increase in final cable size.

The present invention provides a cable in which the conductors are in one or more units of a predetermined number of conductors, with groups within each unit identified by a common color code for one conductor of each pair within the group, and with this color code arranged so that the outside layer presents a predetermined color impression or dominance to indicate the gauge size of the conductors. The units may be identified by the color of their binders and by their position in the cable, or by other means, for example numbered tapes. The invention is particularly applicable to pulp and paper insulated cables, but is also applicable to other forms of cable.

The invention will be understood by the following description of certain embodiments, by way of example, in conjunction with the accompanying drawings, in which:

FIG. 1 is a diagrammatic transverse cross-section through one form of a one hundred pair cable unit;

FIGS. 2 and 3 are similar diagrammatic transverse cross-sections through fifty and twenty-five units;

FIG. 4 is a diagrammatic transverse cross-section through an alternative form of a one hundred pair unit;

Figure 5:
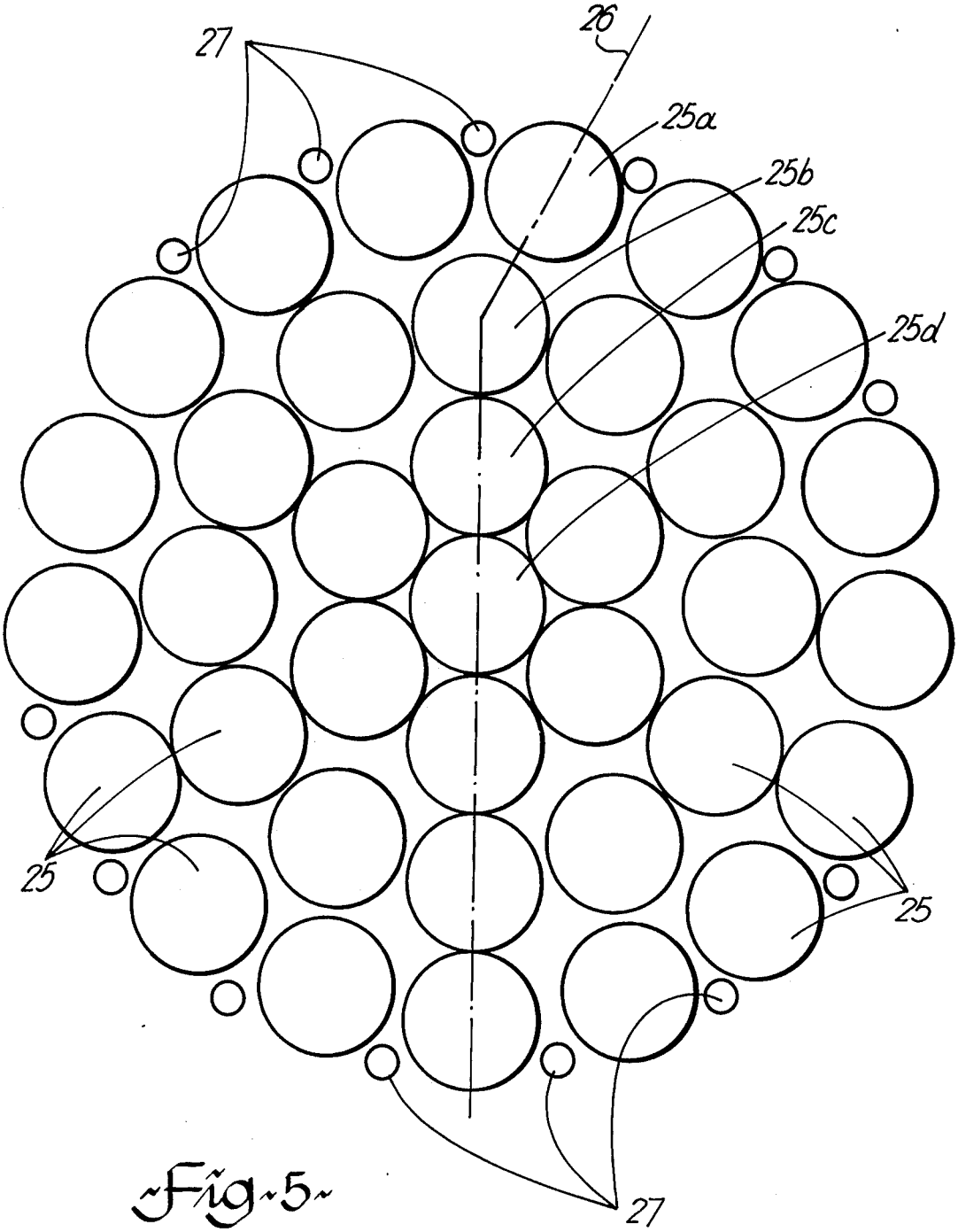
FIG. 5 is a diagrammatic transverse cross-section through a cable.

The drawings, and the following description, relate to telecommunications cables, with the conductors arranged in pairs. Certain specification requirements must be met in order to give satisfactory electrical characteristics, such as mutual capacitance of individual pairs, cross-talk and other features. However, the invention is applicable whether the conductors are in pairs or are not.

As stated, it is necessary that electrical characteristics be acceptable, that is as good as or better than present forms. Also the diameter of a unit should be the same as or less than that of present forms. It is also necessary that the proposed design should be such that the cable can be readily spliced to either the present multiple-unit designs or the present non-multiple-unit designs.

In a unit as illustrated in FIG. 1, there are used four pair colors, one for each twenty-five pair group within a one hundred pair unit. This is a typical unit and group formation for telecommunication cables, but of course the number of pairs forming a unit and a group can be varied. For convenience, one hundred pair fifty pair and twenty-five pair units and twenty-five pair groups will be considered. In the arrangement, as in FIG. 1, and also FIGS. 2 and 3, the units contain two pair colors arranged in layers. Each layer of pairs, in the example, contains three pair twist lays.

Considering specifically FIG. 1, a one hundred pair unit with four twenty-five pair groups, four pair colors are used. Each layer is equally divided between two pair colors in such a way that one half of the one-hundred pair unit contains two twenty-five pair groups. In each layer there are three pair twist lays for each pair color to ensure separation of pairs with the same twist lays. The centre contains one pair from each group. Six pair twist lays are used for each color group, the individual pair twist lays being identified by a stain marking on the white wire of each pair for identification of pairs during manufacture, not being part of the color code.

In all units, the color or colors of the pairs in the outside layer identifies the gauge size of the conductors. A colored binder is applied over the outer layer in each unit to identify the position of the unit in a cable, as will be described later.

Thus, in FIG. 1, as an example, with the individual pairs of a unit 10 represented by the trapezoidal segments 11, a typical pair color and twist lay arrangement is illustrated. The pair colors and twists are as in Table 1A. Table 1A is applicable to all gauges of conductors, while FIG. 1, and also FIGS. 2 and 3, illustrate the particular arrangements for 24 AWG conductors. Colors, and thus the code letters in FIG. 1, and in FIGS. 2 and 3, would change for other gauges, as indicated in Table 1B.

TABLE 1A

| Colors | | | |
|---|---|---|---|
| Ring. Condr. | Tip Condr. | Pair No. | Twist Type No. |
| Red | White/Bk | A1 | 1 |
| Red | White/O | A2 | 2 |
| Red | White | A3 | 3 |
| Red | White/R | A4 | 4 |
| Red | White/B | A5 | 5 |
| Red | White/G | A6 | 6 |
| Orange | White/Bk | B1 | 1 |
| Orange | White/O | B2 | 2 |
| Orange | White | B3 | 3 |
| Orange | White/R | B4 | 4 |
| Orange | White/B | B5 | 5 |
| Orange | White/G | B6 | 6 |
| Green | White/Bk | C7 | 7 |
| Green | White/O | C8 | 8 |
| Green | White | C9 | 9 |

TABLE 1A-continued

| Colors Ring. Condr. | Tip Condr. | Pair No. | Twist Type No. |
|---|---|---|---|
| Green | White/R | C10 | 10 |
| Green | White/B | C11 | 11 |
| Green | White/G | C12 | 12 |
| Blue | White/Bk | D7 | 7 |
| Blue | White/O | D8 | 8 |
| Blue | White | D9 | 9 |
| Blue | White/R | D10 | 10 |
| Blue | White/B | D11 | 11 |
| Blue | White/G | D12 | 12 |

Dash markings on white condr. indicated as follows: /Bk - Black; /R - Red; /G - Green; /O - Orange; /B - Blue.

The pair colors in the outer layer will identify the gauge size as follows:

TABLE 1B

| Gauge | 25 & 50-Pair Units | 100 Pair Units |
|---|---|---|
| 26 AWG | Orange | Orange/Blue |
| 24 AWG | Red | Red/Green |
| 22 AWG | Green | Green/Orange |
| 19 AWG | Blue | Blue/Red |

Thus, considering FIG. 1, for a 24 AWG conductor size unit, the outer layer will have one conductor of each pair, for the left hand side as viewed in FIG. 1, of a solid green color and for the right hand side one conductor of every pair will be solid red color. That is over the semicircumference indicated at 12 one conductor of each pair will be green and for the other semicircumference 13 one conductor of each pair will be red. For a 26 AWG blue and orange form the two semicircumferences, for 22 AWG orange/green and for 19 AWG blue/red. The particular selection of colors can be varied, but once selected should remain a standard.

The other conductor in each pair is coded such that adjacent pairs do not have the same color code. In the particular instance of FIG. 1, the colors in the layers having a solid red conductor in each pair, repeat each three pairs, that is the outside layer repeats white/black, white/orange, white, as in Table IA. The third layer from the outside is also with one conductor of each pair red and the other colors are white/red, white/blue, white/green repeated. The second and fourth and fifth layers, from the outside, are one conductor blue and the other conductor white/red, white/blue or white/green, repeating for the second and fifth layers, and white/-black, white/orange, white, repeating for the fourth layer.

To splice such a unit it is unbound for a short length say 12", and all the pairs having a particular solid color for one conductor of a pair are positioned together to form a group. In the example four groups will be formed. It will be appreciated that FIG. 1 is exemplary only in that some minor migration of pairs can occur and the actual assemblage of conductors will not be perfect as in FIG. 1. However, the migration is very minor and the outside layer will appear very distinctly as being of a two color form, one color for one half and one color for the other half.

A similar arrangement can be used for a fifty pair unit, except that the outer layer will have one conductor of every pair of the same color, so that only one solid color will be in evidence. In FIG. 2, for a fifty pair 24 AWG unit 15, the outer and fourth layers have one conductor in each pair solid red and the other conductor having a white/red, white/blue, white/green, white/black, white/orange or white color. The second and third layers are with green as a solid color and also the centre pair.

For a twenty-five pair unit, if required, again the outer layer will have one conductor of every pair of the same solid color. In FIG. 3, for a twenty-five pair 24 AWG unit 16, the outer layer and centre layer have a conductor in each pair red, and the second layer has one conductor in each pair green.

Variations in the color coding, as illustrated in FIGS. 1, 2 and 3, can be made.

FIG. 4 illustrates an alternate form of a one hundred pair 24 AWG unit. In this form the conductors are laid up in generally concentric circles. The segments 11, in FIG. 4, have a typical pair color and twist lay arrangement as follows:

TABLE 2

| Red Pairs | | | Orange Pairs | | |
|---|---|---|---|---|---|
| Pair Type | Colors | Twist Type No. | Pair Type | Colors | Twist Type No. |
| A1 | R1G | 1 | B1 | O1G | 1 |
| A2 | R2G | 2 | B2 | O2G | 2 |
| A3 | R3G | 3 | B3 | O3G | 3 |
| A4 | R1R | 4 | B4 | O1R | 4 |
| A5 | R2R | 5 | B5 | O2R | 5 |
| A6 | R3R | 6 | B6 | O3R | 6 |
| A7 | R1B | 7 | B7 | O1B | 7 |
| A8 | R2B | 8 | B8 | O2B | 8 |
| A9 | R3B | 9 | B9 | O3B | 9 |
| C1 | G1G | 1 | D1 | B1G | 1 |
| C2 | G2G | 2 | D2 | B2G | 2 |
| C3 | G3G | 3 | D3 | B3G | 3 |
| C4 | G1R | 4 | D4 | B1R | 4 |
| C5 | G2R | 5 | D5 | B2R | 5 |
| C6 | G3R | 6 | D6 | B3R | 6 |
| C7 | G1B | 7 | D7 | B1B | 7 |
| C8 | G2B | 8 | D8 | B2B | 8 |
| C9 | G3B | 9 | D9 | B3B | 9 |

R1G indicates a red-white pair with one green ring on white condr. O2B indicates an orange-white pair with two blue rings on the white conductor, etc.

Fifty and twenty-five pair units can be formed in a similar manner.

A cable is composed of a number of units, and the units are distinguished from one another by a binder. Also the cable is assembled such that a transverse cross-section presents a mirror image about a line passing through one unit in each layer defined as a marker unit. Due to the way the various layers form, the marker unit in each layer will not necessarily lie on a straight line, the line being somewhat zig-zag.

This is seen in FIG. 5, which is a transverse cross-section of a 3600 pair cable having thirty-six units 25, with a central unit and three layers of units. Each unit, for example, will be as FIG. 1. The marker units are indicated at **25*a*, 25*b*, 25*c*, 25*d* and the line dividing the cable is at 26**.

In one arrangement of a cable as in FIG. 5, the marker unit **25*a* is bound with a green binder, the next layer binder unit 25*b* bound with a green/white binder, marker unit 25*c* with a green binder and the centre unit 25*d* with a green/white binder. This color arrangement may be repeated in additional layers, if necessary. The remaining units in a layer are coded by binders in one of two colors. Thus the units on either side of marker unit 25*d* are bound with red binders, the next units each side with blue binders, then red then blue and so on. This is also the coding for the layer with marker unit 25c**. For the intervening layer, or layers, with green/white binders, the sequence is red/white binder each side of the marker unit, then blue/white and repeated.

Spare pairs of conductors are provided as in conventional cables. For example, a 3600 pair cable might have 13 spare pairs. The position of the spare pairs are indicated at 27 in FIG. 5. There is also provided a color coding for the spares. Thus a red/blue pair is always positioned alongside the marker unit. Depending upon which end of a cable is being considered, the red/blue pair will be on one side or the other of the marker unit. This then sets the rotational direction of working round a cable. For example, when the cable end is uncovered, by removal of coating and other layers, if the red/blue pair is on the right of the marker unit, the person doing the splicing proceeds in a clockwise direction around the layer. Similarly, if the red/blue pair is on the left of the marker unit, the procedure is anti-clockwise.

The arrangement illustrated in FIG. 5 is somewhat idealistic in that the units 25 are not rigid circular members but bundles of wires, and thus some deformation of the units, and relative movement of units, one to another, will occur, but this is not enough to interfere with the color coding system. After the cable core has been formed, as illustrated, it is provided with a conventional cable sheath, usually consisting of metallic and plastic material layers.

While the invention has been described particularly with respect to 26, 24, 22 and 19 AWG conductors, it will be appreciated that it can readily be applied to other gauges.

What is claimed is:

1. A telecommunications cable comprising a plurality of twisted pairs of conductors arranged in a number of groups and the groups arranged in at least two units with at least two groups in a unit, the conductor pairs in a group having a colour coding unique to that group, each group having at least twenty five twisted pairs of conductors;

said colour coding comprising a preselected common colour identification common to one conductor of each pair in a group and the other conductor of each pair having a colour identification which is one of a predetermined number of different colour identifications clearly distinguishable from said common colour identification and defining, in conjunction with said common colour identification of said one conductor, the twist type for each pair in said group, the number of twist types in a group less than the numbers of pairs of conductors in the group, a group identified only by said common colour identification, and a different common colour identification for each group in a unit; and a binder around each unit;

any one pair of conductors in a unit having a particular twist type being separated from any other pair of conductors having the same twist type by a minimum distance of the order of two pairs of conductors.

2. A cable as claimed in claim 1, each unit comprising one hundred pairs of conductors divided into four groups of twenty-five pairs.

3. A cable as claimed in claim 1, the pairs of conductors in a unit arranged in a plurality of layers, pairs having the same twist type separated by at least two other pairs in a layer and between layers.

4. A cable as claimed in claim 1, each unit having an outer layer composed of pairs of conductors of one group for one half of the layer and of pairs of conductors of another group for the other half of the layer.

5. A cable as claimed in claim 1, succeeding layers composed of pairs of conductors of one group for one half of the layers and of pairs of conductors of another group for the other half of the layer.

6. A cable as claimed in claim 1, the conductors being pulp or paper insulated.

7. A cable as claimed in claim 1, the conductor pairs in a unit positioned to provide an outer layer of conductor pairs having a predetermined colour impression to define the gauge size of the conductors in the unit.

8. A cable as claimed in claim 1, each of said twist types in a group occurring at least twice in each group.

9. A cable as claimed in claim 1, each unit comprising fifty pairs of conductors divided into two groups of twenty-five pairs.

10. A cable as claimed in claim 1, each unit including one extra pair of conductors, not forming part of a group.

11. A cable as claimed in claim 10, each unit including at least one extra pair of conductors for each group, said extra pairs not forming a part of any group.

12. A cable as claimed in claim 11, comprising a plurality of units arranged substantially in a plurality of layers, one unit in each layer defined as a marker unit, said marker units defining a line passing transversely across the cable, the remaining units arranged either side of said line to form a mirror image on one side relative to the other.

* * * * *